US010670346B2

(12) United States Patent
Army et al.

(10) Patent No.: US 10,670,346 B2
(45) Date of Patent: Jun. 2, 2020

(54) CURVED HEAT EXCHANGER

(71) Applicant: Hamilton Sundstrand Corporation, Charlotte, NC (US)

(72) Inventors: Donald E. Army, Enfield, CT (US); Luke J. Mayo, Coventry, CT (US); William T. Lockwood, Windsor Locks, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 27 days.

(21) Appl. No.: 15/862,211

(22) Filed: Jan. 4, 2018

(65) Prior Publication Data

US 2019/0204012 A1 Jul. 4, 2019

(51) Int. Cl.
*F28D 9/00* (2006.01)
*F28F 9/26* (2006.01)
(Continued)

(52) U.S. Cl.
CPC ..... *F28D 9/0012* (2013.01); *F28D 7/005* (2013.01); *F28D 7/02* (2013.01); *F28D 9/0068* (2013.01);
(Continued)

(58) Field of Classification Search
CPC ..... F28D 9/0062; F28D 9/0093; F28F 3/026; F28F 9/26; F28F 9/0025; F28F 2210/10; F28F 2240/00
See application file for complete search history.

(56) References Cited

U.S. PATENT DOCUMENTS 1,947,913 A * 2/1934 McGrail ..... F28D 1/0246 165/130
2,650,073 A * 8/1953 Holm ..... F02C 7/143 165/140
(Continued)

FOREIGN PATENT DOCUMENTS

DE 102010046471 A1 3/2012
JP S56146986 A 11/1981
(Continued)

OTHER PUBLICATIONS

Extended European Search Report for EP Application No. 18203835.6, dated May 15, 2019, 12 pages.
(Continued)

*Primary Examiner* — Devon Russell
(74) *Attorney, Agent, or Firm* — Kinney & Lange, P.A.

(57) ABSTRACT

A heat exchanger assembly includes first and second annular ducts, first and second airflow pathways, and heat exchanger. The first airflow pathway is configured to transport a first airflow and is disposed within the first annular duct. The second annular duct is disposed radially outward from the first annular duct. The second airflow pathway is configured to transport a second airflow and is disposed between the first and second annular ducts. The heat exchanger includes inner and outer portions. The inner portion is disposed radially inward of the first annular duct and is fluidly connected to the first airflow pathway. The outer portion is disposed between the first and second annular ducts and is fluidly connected to the second airflow pathway. The heat exchanger is configured to cool a third airflow with both of the first and second airflows from the first and second airflow pathways.

10 Claims, 9 Drawing Sheets

(51) Int. Cl.

| | |
|---|---|
| ***F28F 9/02*** | (2006.01) |
| ***F28D 7/02*** | (2006.01) |
| ***F28D 7/00*** | (2006.01) |
| *F28D 21/00* | (2006.01) |
| *F28F 3/02* | (2006.01) |

(52) U.S. Cl.
CPC ..... *F28D 9/0093* (2013.01); *F28F 9/0224* (2013.01); *F28F 9/26* (2013.01); *F28D 2021/0026* (2013.01); *F28F 3/025* (2013.01)

(56) References Cited

U.S. PATENT DOCUMENTS 3,289,757 A * 12/1966 Rutledge ..... F25J 3/04412 165/166
3,570,593 A * 3/1971 Isaaz ..... F28D 7/0041 165/166
3,818,984 A * 6/1974 Nakamura ..... F28D 9/0018 165/166
4,248,297 A * 2/1981 Pei ..... C03B 23/207 165/10
4,374,469 A * 2/1983 Rannenberg ..... B64D 13/06 62/172
4,379,487 A * 4/1983 Krakow ..... B01F 5/0641 165/165
4,438,809 A * 3/1984 Papis ..... F28D 9/0018 165/166
4,582,126 A * 4/1986 Corey ..... F02F 7/0087 165/82
5,004,044 A * 4/1991 Horgan ..... F28D 9/0012 165/145
6,293,338 B1 * 9/2001 Chapman ..... F28D 9/0018 165/166
6,494,031 B2 * 12/2002 Takehara ..... F23L 15/04 60/39.512
7,065,873 B2 * 6/2006 Kang ..... F28D 9/0018 165/166
9,513,059 B2 * 12/2016 Maurer ..... F28D 7/0058
9,766,019 B2 * 9/2017 Eleftheriou ..... F02C 7/08
10,316,750 B2 * 6/2019 Loebig ..... F02K 3/115
10,371,053 B2 * 8/2019 Loebig
2002/0124569 A1 * 9/2002 Treece ..... F02C 3/05 60/772
2004/0112576 A1 * 6/2004 Meshenky ..... F02B 29/0462 165/125
2005/0087330 A1 * 4/2005 Kang ..... F02C 7/08 165/166
2005/0252193 A1 * 11/2005 Iya ..... F02K 1/822 60/204
2007/0056721 A1 * 3/2007 Usui ..... F28D 7/1684 165/183
2007/0125527 A1 * 6/2007 Flik ..... F02B 29/0412 165/140
2012/0039762 A1 * 2/2012 Rizzi ..... B01J 8/0257 422/200
2012/0144842 A1 * 6/2012 Snyder ..... F01D 25/12 60/785
2014/0144611 A1 * 5/2014 Yoshimura ..... F28F 7/02 165/168
2015/0027676 A1 * 1/2015 Eilken ..... B64C 1/12 165/168
2015/0260459 A1 * 9/2015 Cameron ..... F28D 9/0031 165/167
2015/0329213 A1 * 11/2015 Russ ..... B64D 41/007 60/226.1
2016/0025007 A1 * 1/2016 Honnorat ..... F28F 9/0265 60/39.511
2016/0123230 A1 * 5/2016 Thomas ..... F28D 1/0358 60/772
2017/0341759 A1 * 11/2017 Bruno ..... B64D 13/02
2017/0341767 A1 * 11/2017 Bruno ..... B64D 13/02
2017/0341768 A1 * 11/2017 Bruno ..... B64D 13/08
2019/0135441 A1 * 5/2019 Bruno ..... B64D 13/06

FOREIGN PATENT DOCUMENTS

JP S56149686 A 11/1981
JP 2016088290 A 5/2016
WO WO2017090595 A1 6/2017

OTHER PUBLICATIONS

Extended European Search Report for EP Application No. 18203835.6, dated Aug. 26, 2019, 11 pages.

* cited by examiner

CURVED HEAT EXCHANGER

STATEMENT OF GOVERNMENT INTEREST

This invention was made with government support under FA8626-16-C-2139 awarded by United States Air Force. The government has certain rights in the invention.

BACKGROUND

The present disclosure relates to a heat exchanger. More particularly, the present disclosure relates to a curved heat exchanger for use in a gas turbine engine.

In some portions of gas turbine engines, available space for mounting certain hardware elements is limited to curved, annular regions of space. When placed in these annular spaces, the use of existing rectangular shaped pieces of hardware limits the size and efficiency of the hardware.

SUMMARY

A heat exchanger assembly includes first and second annular ducts, first and second airflow pathways, and a heat exchanger with a partially annular shape. The first annular duct forms a fluidic barrier between the first and second airflow pathways. The first airflow pathway is configured to transport a first airflow and is disposed within and formed by the first annular duct. The second annular duct is disposed radially outward from the first annular duct. The second airflow pathway is configured to transport a second airflow and is disposed between and formed by the first and second annular ducts. The heat exchanger includes inner and outer portions. The inner portion is disposed radially inward of the first annular duct and is fluidly connected to the first airflow pathway. The outer portion is disposed between the first and second annular ducts and is fluidly connected to the second airflow pathway. The heat exchanger is configured to cool a third airflow with both of the first and second airflows from the first and second airflow pathways.

A method of manufacturing a heat exchanger with cold layers and hot layers includes manipulating each of the cold layers such that each of the cold layers includes a tapered side profile. The cold and hot layers are arranged into an alternating pattern such that each of the hot layers is adjacent to and in contact with at least one of the cold layers. The hot layers and cold layers are brazed together to form a core.

A heat exchanger for an engine with a duct and first and second airflow pathways includes a partially annular curved core, an inner portion fluidly connected to the first airflow pathway, and an outer portion disposed radially outward from the inner portion. The partially annular curved core includes a plurality of hot layers and a plurality of cold layers. Each of the plurality of hot layers is configured to transport a third airflow. The hot and cold layers are arranged in a stack such that each of the plurality of hot layers is adjacent to and in contact with at least one of the cold layers in the stack. Each of the cold layers comprises a taper in a radial direction such that a radially outward end of each of the cold layers is larger than a radially inward end of each of the cold layers along a circumferential direction of the partially annular curved core. The inner portion comprises radially inward halves of the hot and cold layers. The outer portion is fluidly connected to the second airflow pathway and comprises radially outward halves of the hot and cold layers. The heat exchanger is configured to cool the third airflow with airflows from the first and second airflow pathways.

The present summary is provided only by way of example, and not limitation. Other aspects of the present disclosure will be appreciated in view of the entirety of the present disclosure, including the entire text, claims, and accompanying figures.

Figure 1:
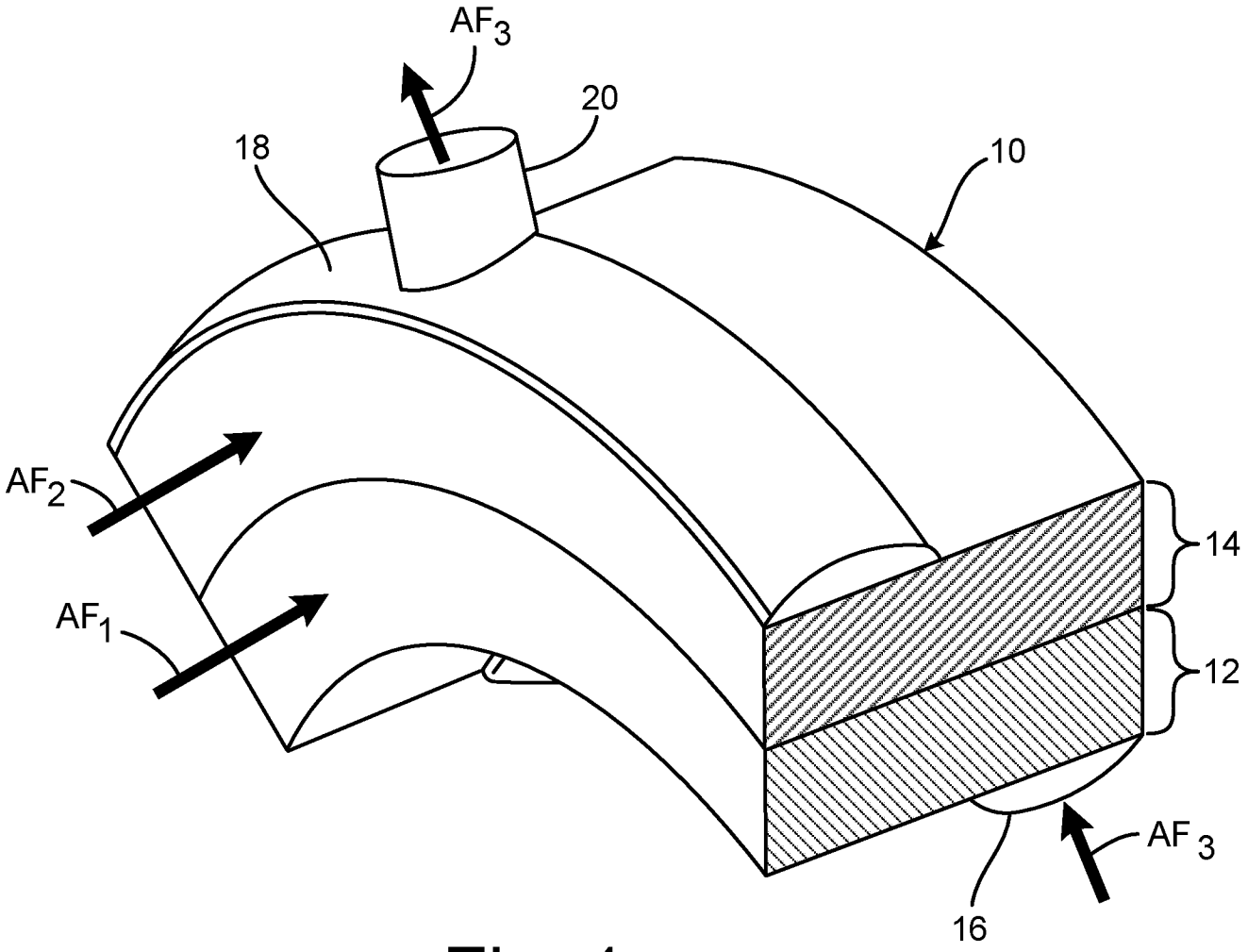
FIG. 1 is a perspective view of an annular heat exchanger showing the direction of air flow through the heat exchanger.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

FIG. 1 is a perspective view of heat exchanger 10 and shows directions of flow of first airflow $AF_1$, second airflow $AF_2$, and third airflow $AF_3$ through heat exchanger 10. FIG. 1 also shows heat exchanger 10 (with inner portion 12, outer portion 14, inlet header 16, and outlet header 18), and outlet 20.

Heat exchanger 10 is a heat exchanger in the shape of a partial annulus. In one non-limiting embodiment, heat exchanger is a circumferentially stacked counter-flow curved heat exchanger. As will be discussed in FIGS. 4-8, heat exchanger 10 includes a series of hot fins and cold fins assembled into a circumferentially stacked core. Inner portion 12 is a radially inward portion of heat exchanger 10. Outer portion 14 is a radially outward portion of heat exchanger 10. Inlet header 16 is a fluidic inlet of heat exchanger 10. Outlet header 18 is a fluidic outlet of heat exchanger 10. First airflow $AF_1$ and second airflow $AF_2$ are flows of cool or cold air. Third airflow $AF_3$ is a flow of warm or hot air. Outlet 20 is a tubular shaped piece of solid material such as metal. Outlet 20 is connected to and in fluid communication with outlet header 18.

Inner portion 12 is connected to and extends radially inward from outer portion 14 of heat exchanger 10. Outer portion 14 is connected to and extends radially outward from inner portion 12 of heat exchanger 10. Inlet header 16 is mounted onto inner portion 12 of heat exchanger 10. Outlet header 18 is mounted onto outer portion 14 of heat exchanger 10. Outlet 20 extends radially outward from outlet header 18. First airflow $AF_1$ flows into and through inner portion 12 (in a direction from left to right as shown in FIG. 1). Second airflow $AF_2$ flows into and through outer portion 14 (in a direction from left to right as shown in FIG. 1). Third airflow $AF_3$ flows in to inner portion 12 of heat exchanger 10 via inlet header 16. Third airflow $AF_3$ flows out of outer portion 14 of heat exchanger 10 via outlet header 18 and outlet 20. Outlet 20 expels third airflow $AF_3$ out of heat exchanger 10.

In heat exchanger 10 with separate inner portion 12 and outer portion 14, third airflow $AF_3$ goes into heat exchanger 10 and is cooled first by first airflow $AF_1$ passing through inner portion 12 and then by second airflow $AF_2$ passing through outer portion 14. Here, there are two discrete sections (e.g., inner portion 12 and outer portion 14) being cooled by two different and independent flows of cooling air (e.g., first airflow $AF_1$ and second airflow $AF_2$). In existing designs, multiple flows of hot air are cooled by a single flow of cold air. Additionally, first airflow $AF_1$ and second airflow $AF_2$ are configured to cool third airflow $AF_3$ in a parallel relationship as compared to a series relationship in existing heat exchanger assemblies. In one non-limiting embodiment, the temperatures of first airflow $AF_1$ and second airflow $AF_2$ can be different.

Figure 2:
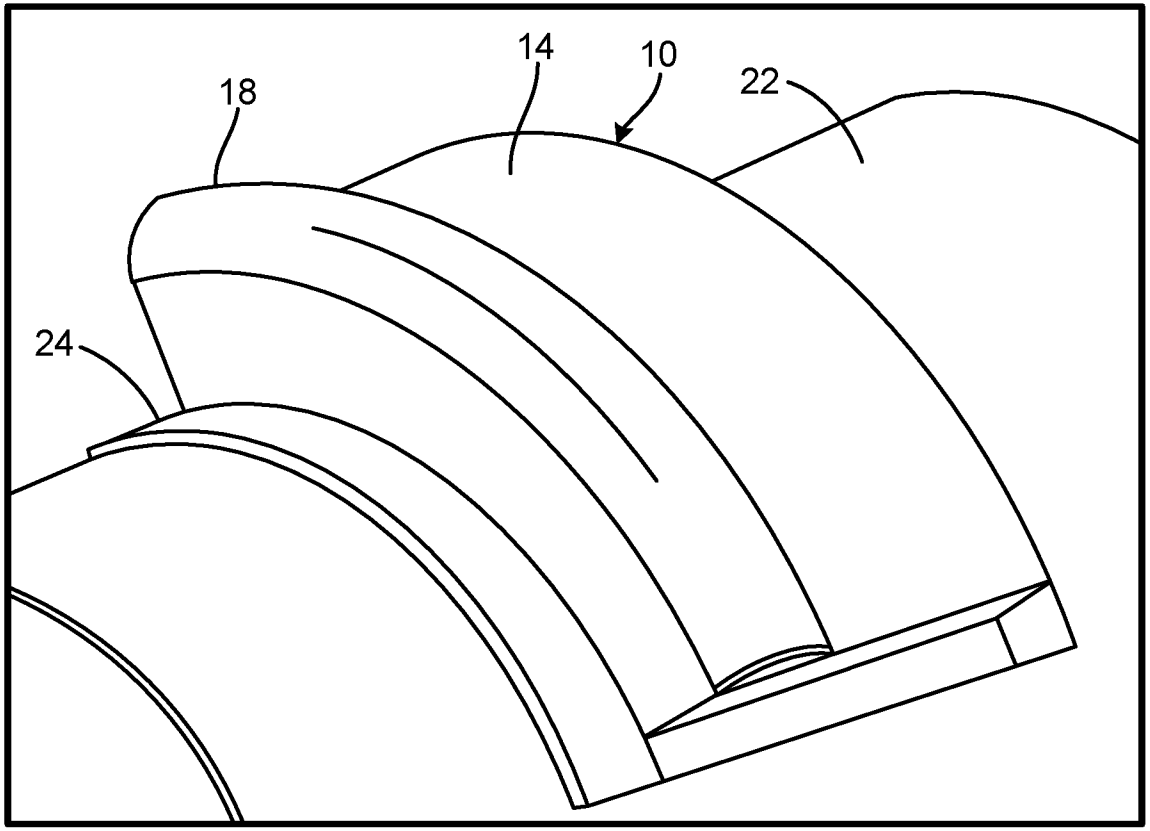
FIG. 2 is a perspective view of the heat exchanger mounted onto an inner duct.
Figure 3:
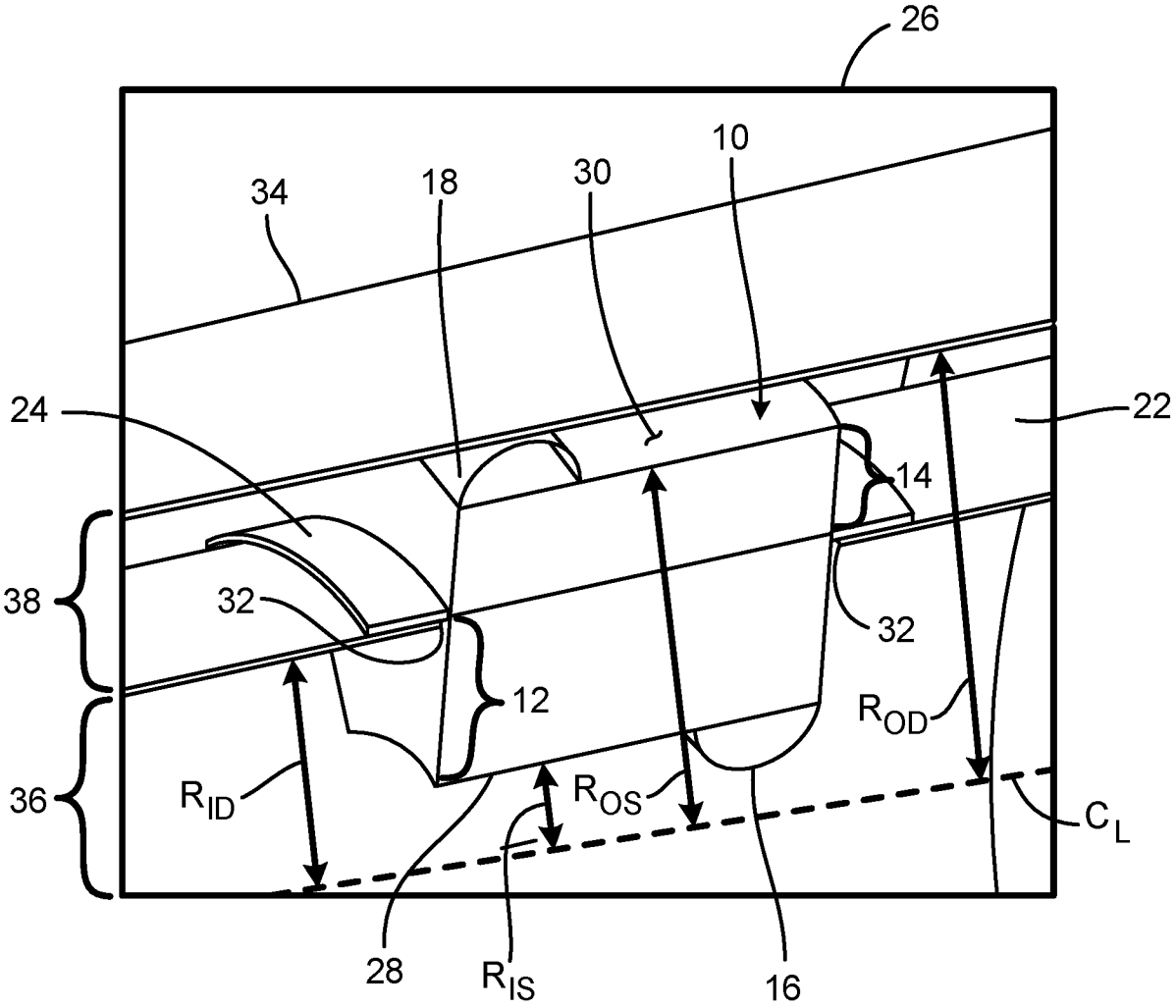
FIG. 3 is a perspective cut-away view of the heat exchanger mounted partially between a first duct and a second duct.

FIG. 2 is a perspective view of heat exchanger 10 mounted onto inner duct 22 and shows heat exchanger 10 (with outer portion 14 and outlet header 18), inner duct 22, and mounting flange 24. FIG. 3 is a perspective cut-away view of assembly 26 including heat exchanger 10 (with inner portion 12, inner surface 28, outer portion 14, outer surface 30, inlet header 16, and outlet header 18), inner duct 22 (with cutout 32), mounting flange 24, outer duct 34, first airflow pathway 36, and second airflow pathway 38. FIG. 3 also shows radius $R_{ID}$ of inner duct 22, radius $R_{OD}$ of outer duct 34, radius $R_{IS}$ of inner surface 28, and radius $R_{OS}$ of outer surface 30. FIGS. 2 and 3 show similar elements, and will be discussed in tandem.

Inner duct 22 and outer duct 34 are annular tubes of solid material such as metal. In one non-limiting embodiment, either inner duct 22 or outer duct 34 can be an engine fan case. Radius $R_{ID}$ and radius $R_{OD}$ are radii of inner duct 22 and outer duct 34, respectively relative to axial centerline $C_L$. Mounting flange 24 is a curved ribbon of solid material. Assembly 26 is a group of mechanical elements. Inner surface 28 is a curved, radially inward surface of inner portion 12 of heat exchanger 10. Radius $R_{IS}$ is a radius of inner surface 28 measured from axial centerline $C_L$. Outer surface 30 is a curved, radially outward surface of outer portion 14 of heat exchanger 10. Radius $R_{OS}$ is a radius of outer surface 30 measured from axial centerline $C_L$. Cutout 32 is a hole or opening. First airflow pathway 36 is an annular passage configured for the transport of a fluid such as air. Second airflow pathway 38 is an annular or ring-shaped passage configured for the transport of a fluid such as air.

Heat exchanger 10 is disposed in cutout 32 of inner duct 22 and is mounted to inner duct 22 via mounting flange 24. In this non-limiting embodiment, the curvature or curved shape of heat exchanger 10 conforms to and/or is complimentary with the curvature or curved shape of either inner duct 22 or outer duct 34. In another non-limiting embodiment, the curvature or curved shape of inner surface 28 of inner portion 12 conforms to and/or is complimentary with the curvature or curved shape of inner duct 22. In another non-limiting embodiment, the curvature or curved shape of outer surface 30 of outer portion 14 conforms to and/or is complimentary with the curvature or curved shape of outer duct 34. In another non-limiting embodiment, the difference between radius $R_{OS}$ of outer surface 30 and radius $R_{OD}$ of outer duct 34 remains generally constant along a circumference of outer duct 34 (or along a circumference of outer surface 30). In another non-limiting embodiment, the difference between radius $R_{IS}$ of inner surface 28 and radius $R_{ID}$ of inner duct 22 remains generally constant along a circumference of inner duct 22 (or along a circumference of inner surface 28).

Inner portion 12 of heat exchanger 10 is disposed in and is in fluid communication with first airflow pathway 36. Outer portion 14 of heat exchanger 10 is disposed in and is in fluid communication with second airflow pathway 38. Inlet header 16 extends partially into a portion of first airflow pathway 36. Inlet header 16 is fluidly connected to a source of hot air. Outlet header 18 extends partially into a portion of second airflow pathway 38. Outlet header 18 is fluidly connected to hot air discharge region of assembly 26. Inner duct 22 is disposed radially inward from outer duct 34. Inner duct 22 forms an outer barrier of first airflow pathway 36 and forms an inner barrier of second airflow pathway 38. In this non-limiting embodiment, radius $R_{ID}$ of inner duct 22 is greater than radius $R_{IS}$ of inner surface 28 and is less than both radius $R_{OD}$ of outer duct 34 and radius $R_{OS}$ of outer surface 30.

Mounting flange 24 is connected to and extends axially (and/or circumferentially) from sides of heat exchanger 10. A shape of mounting flange 24 includes a curved ribbon that matches a shape of inner duct 22. For example, a curvature of mounting flange 24 is approximately equal to a curvature of inner duct 22. Mounting flange 24 is mounted to inner duct 22 via mechanical or chemical attachment such as fasteners, adhesives, or welding. In this non-limiting embodiment, mounting flange 24 extends out from heat exchanger 10 on all four sides of heat exchanger 10 (as shown in FIG. 2). In other non-limiting embodiments, mounting flange 24 can extend from less than the four sides of heat exchanger 10. In this non-limiting embodiment, each of radius $R_{ID}$, radius $R_{OD}$, radius $R_{IS}$, and radius $R_{OS}$ are concentric and co-axial with axial centerline $C_L$. Assembly 26 is disposed in a portion of an engine. In one non-limiting embodiment, assembly 26 can be mounted in a portion of an aircraft engine.

Inner surface 28 is disposed along a radially inward surface of inner portion 12 of heat exchanger 10. In this non-limiting embodiment, radius $R_{IS}$ of inner surface 28 is less than radius $R_{OS}$ of outer surface 30, radius $R_{OD}$ of outer duct 34, and radius $R_{ID}$ of inner duct 22. Outer surface 30 is disposed along a radially outward surface of outer portion 14 of heat exchanger 10. In this non-limiting embodiment, radius $R_{OS}$ of outer surface 30 is less than radius $R_{OD}$ of outer duct 34 and is greater than radius $R_{IS}$ of inner surface 28 and radius $R_{ID}$ of inner duct 22. Cutout 32 is disposed in (e.g., cut out of) a portion of inner duct 22 and is shaped to receive heat exchanger 10. Outer duct 34 surrounds and is disposed radially outward from inner duct 22. Outer duct 34 forms outer barrier of second airflow pathway 38. In this non-limiting embodiment, radius $R_{OD}$ of outer duct 34 is greater than radius $R_{IS}$ of inner surface 28, radius $R_{ID}$ of inner duct 16, and radius $R_{OS}$ of outer surface 30.

First airflow pathway 36 is disposed within and travels through inner duct 22. First airflow pathway 36 is in fluid communication with inner portion 12 of heat exchanger 10. Second airflow pathway 38 is a disposed within and travels between inner duct 22 and outer duct 34. Second airflow pathway 38 is in fluid communication with outer portion 14 of heat exchanger 10.

Heat exchanger 10 functions to transfer heat from a hot airflow flowing through heat exchanger 10 to first and second airflow pathways 18 and 20, which in this non-limiting embodiment are both cold airflows that are separate from each other. Inner portion 12 receives a portion of the airflow from first airflow pathway 36. Heat is transferred from the hot airflow in heat exchanger 10 to the portion of the airflow from first airflow pathway 36 passing through inner portion 12. Outer portion 14 receives a portion of the airflow from second airflow pathway 38. Heat is transferred from the hot airflow in heat exchanger 10 to the portion of second airflow pathway 38 passing through outer portion 14.

Inlet header 16 receives hot airflow and transports the hot airflow into inner portion 12 of heat exchanger 10. Outlet header 18 vents out the hot airflow from outer portion 14 from heat exchanger 10 after the hot airflow has flown through both inner and outer portions 12 and 14 of heat exchanger 10. Assembly 26 functions to provide a curved heat exchanger that fits within the design envelope of inner duct 22 and outer duct 34 so as to maximize the amount of space taken up by heat exchanger 10 within assembly 26. Inner duct 22 functions to guide and transport first airflow pathway 36 through inner duct 22. Cutout 32 functions to provide a mounting space for heat exchanger 10. A shape of a boundary of cutout 32 is sized to match a shape of heat exchanger 10 at a portion of heat exchanger next to mounting flange 24. Outer duct 34 functions to guide and transport second airflow pathway 38 through outer duct 34. First airflow pathway 36 functions to provide inner portion 12 of heat exchanger 10 with a first cooling airflow. Second airflow pathway 38 functions to provide outer portion 14 of heat exchanger 10 with a second cooling airflow.

Mounting flange 24 is used to mount heat exchanger 10 to inner duct 22 of assembly 26. In this non-limiting embodiment, mounting flange 24 is mounted onto a radially outward surface on inner duct 22. In other non-limiting embodiments, mounting flange 24 can be mounted onto a radially inward facing surface of inner duct 22. In addition to providing a mounting function, mounting flange 24 also provides additional heat transfer between heat exchanger 10 and second airflow pathway 38 and inner duct 22. Mounting flange 24 is mounted to inner duct 22 via a series of bolts and locking nut plates.

The curved shape of heat exchanger 10 allows heat exchanger 10 to more efficiently use the space between inner duct 22 and outer duct 34 as compared to traditional rectangular heat exchangers. Using curved heat exchanger 10 in assembly 26 allows for the use of space to be maximized due to the shape of heat exchanger 10 matching the contour of the curved shape of outer duct 34 and minimizing a space or gap between outer surface 30 of heat exchanger 10 and outer duct 34. In other words, the curved shape of heat exchanger 10 provides maximum utilization of available space by heat exchanger 10 within assembly 26. By maximizing the amount of space taken up by heat exchanger 10 within the design envelope of assembly 26, a greater amount of space inside of assembly 26 (e.g., between and within inner and outer ducts 22 and 34) is utilized for thermal management as compared to existing designs of rectangular, box, or cubic shaped heat exchangers placed in curved spaces.

Figure 4:
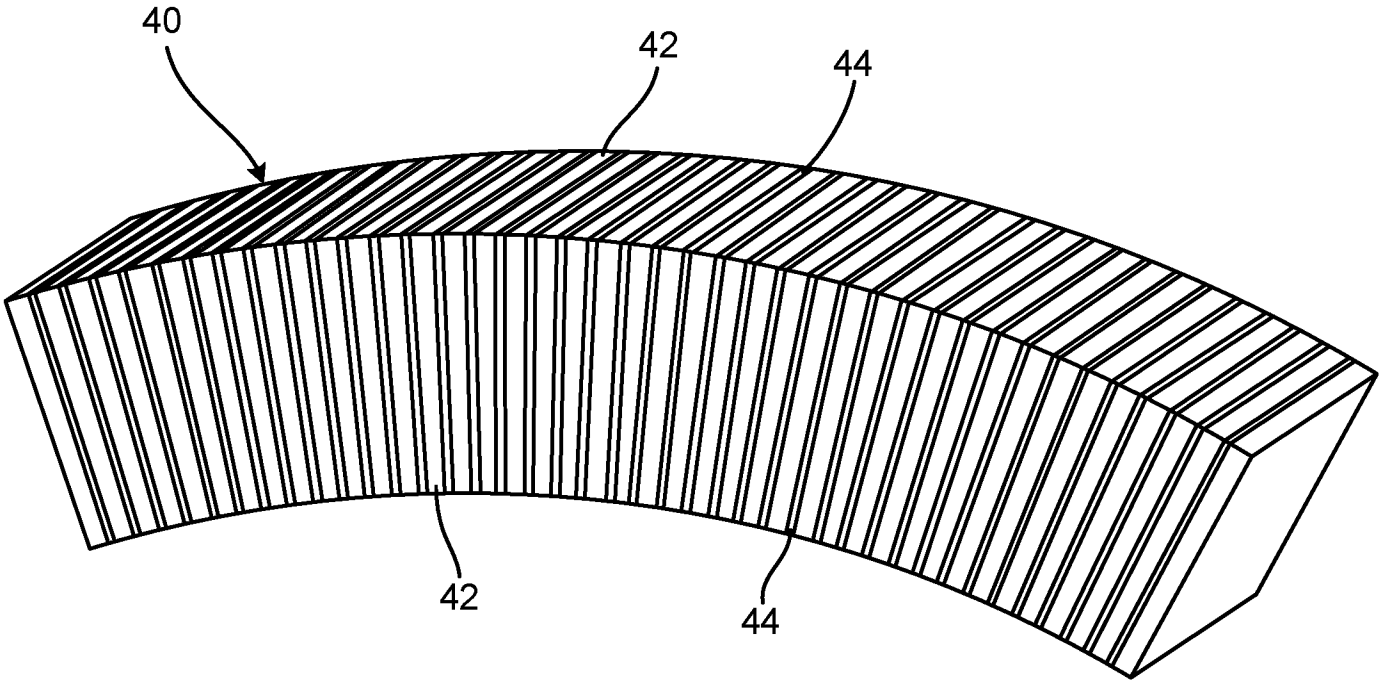
FIG. 4 is a perspective view of a core of the heat exchanger with a plurality of cold layers and a plurality of hot layers.

FIG. 4 is a perspective view of core 40 of heat exchanger 10 with cold layers 42 and hot layers 44. Core 40 is a curved, circumferentially-shaped stack of layers of heat exchanger fins. Each of cold layers 42 and each of hot layers 44 are layers of heat exchanger fins. Each of cold layers 42 includes a side-profile that is tapered from a radially inward end of each of cold layers 42 (bottom end as shown in FIG. 4) towards a radially outward end. For example, in this non-limiting embodiment, the radially inward end of each of cold layers 42 is narrower than the respective radially outward end of each of cold layers 42 (as will also be shown and discussed in FIGS. 6A-6B).

Cold layers 42 and hot layers 44 are arranged in an alternating relationship such that every other layer is a cold layer 42, hot layer 44, cold layer 42, . . . etc. Core 40 gets its curved shaped from the fact that each of cold layers 42 is tapered towards the radially inward ends. As core 40 is formed by every other layer of colds fins 42 and hot fins 44, the tapered shape of cold fins 42 creates a slight radially inward curvature of core 40 at each of cold fins 42. The curved shape of core 40 by way of the tapered shape of cold fins 42 allows heat exchanger 10 to have a curved shape conforming to the curvature of inner and outer ducts 22 and 34.

Figure 5:
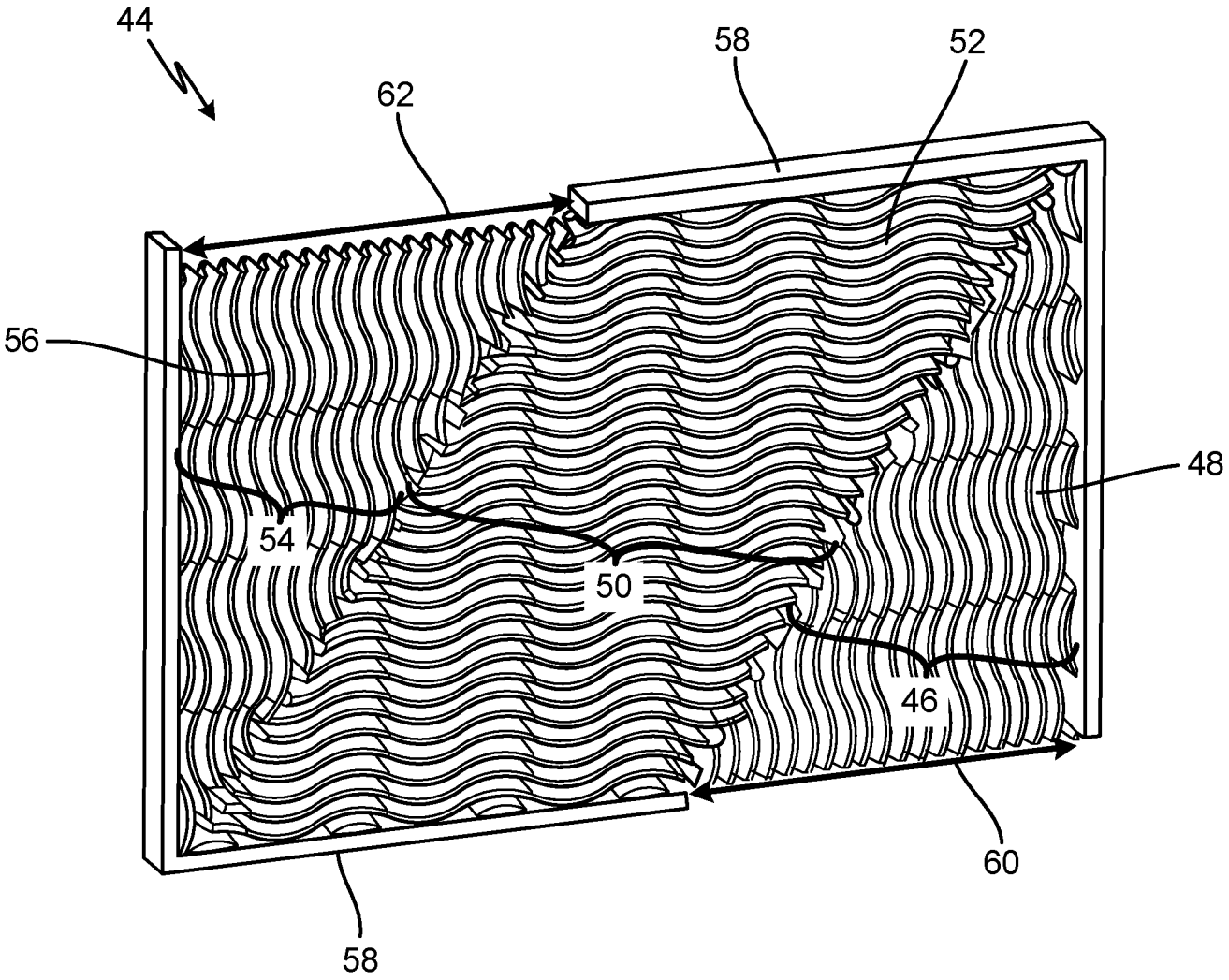
FIG. 5 is a perspective view of a hot layer of the heat exchanger.

FIG. 5 is a perspective view of hot layer 44 of heat exchanger 10 and shows first region 46 of first fins 48, second region 50 of second fins 52, third region 54 of third fins 56, and sidewall 58 with first opening 60 and second opening 62.

Across hot layer 44, a width, height, and length of hot layer 44 remain consistent. First region 46 is a first region of hot layer 44 designated by fins that are oriented in a generally vertical orientation (as shown in FIG. 5). First fins 48, second fins, 52, and third fins 56 are wavy or undulating heat exchanging fins that form fluidic channels. Second region 50 is a second region of hot layer 44 designated by wavy or undulating fins that are oriented in a generally horizontal orientation (as shown in FIG. 5). Third region 54 is a third region of hot layer 44 designated by wavy or undulating fins that are oriented in a generally vertical orientation (as shown in FIG. 5). Sidewall 58 is a wall of solid material. First opening 60 and second opening 62 are cutouts, openings, and/or points of discontinuity in sidewall 58.

First region 46 is disposed within a portion of sidewall 58. First region 46 of first fins 48 is connected to and in fluid communication with first opening 60 and with second region 50 of second fins 52. First fins 48 are interconnected to form a single wavy sheet of physical material. First fins 48, second fins 52, and third fins 56 are configured in such a way so as to maximize a surface area of hot layer 44 so as to increase the heat exchanging capabilities of hot layer 44. Second region 50 is disposed within a portion of sidewall 58. Second region 50 of second fins 52 is connected to and in fluid communication with first region 46 of first fins 48 and third region 54 of third fins 56. Second fins 52 are interconnected to form a single wavy sheet of physical material. Third region 54 is disposed within a portion of sidewall 58. Third region 54 of third fins 56 is connected to and in fluid communication with second opening 62 and second region 50 of second fins 52. Third fins 56 are interconnected to form a single wavy sheet of physical material.

Sidewall 58 surrounds portions of first region 46 of first fins 48, second region 50 of second fins 52, and third region 54 of third fins 56. First opening 60 and second opening 62 are formed in portions of sidewall 58. First opening 60 is fluidly connected to first region 46 of first fins 48. Second opening 62 is fluidly connected to third region 54 of third fins 56.

Each of first region 46, second region 50, and third region 54 of fins function to transport a flow of air (e.g., third airflow $AF_3$ from FIG. 3) through hot layer 44. Each of first fins 48, second fins 52, and third fins 56 provide individual fluidic channels through which the flow of air is transported. First fins 48, second fins 52, and third fins 56 also provide the function of heat transfer between a surface area of the fins and the flow of air passing across first fins 48, second fins 52, and third fins 56. Sidewall 58 forms a fluidic barrier on sides of hot layer 44 so as to contain and control the flow of air through hot layer 44. Sidewall 58 directs the flow of air from first opening 60, into first region 46, through second region 50, through third region 54, and out of second opening 62.

As will be discussed in relation to other figures, the configuration of hot layer 44 with first, second, and third regions 46, 50, and 54 allows for hot layer 44 with a single flow of hot air to be cooled by two independent flows of cold air by cold layers 42. Cooling of the flow of hot air through hot layer 44 with two independent flows of cold air via cold layers 42 provides increased cooling of the flow of hot air through hot layers 44 as compared to multiple flows of hot air being cooled by a single flow of cold air.

Figure 6A:
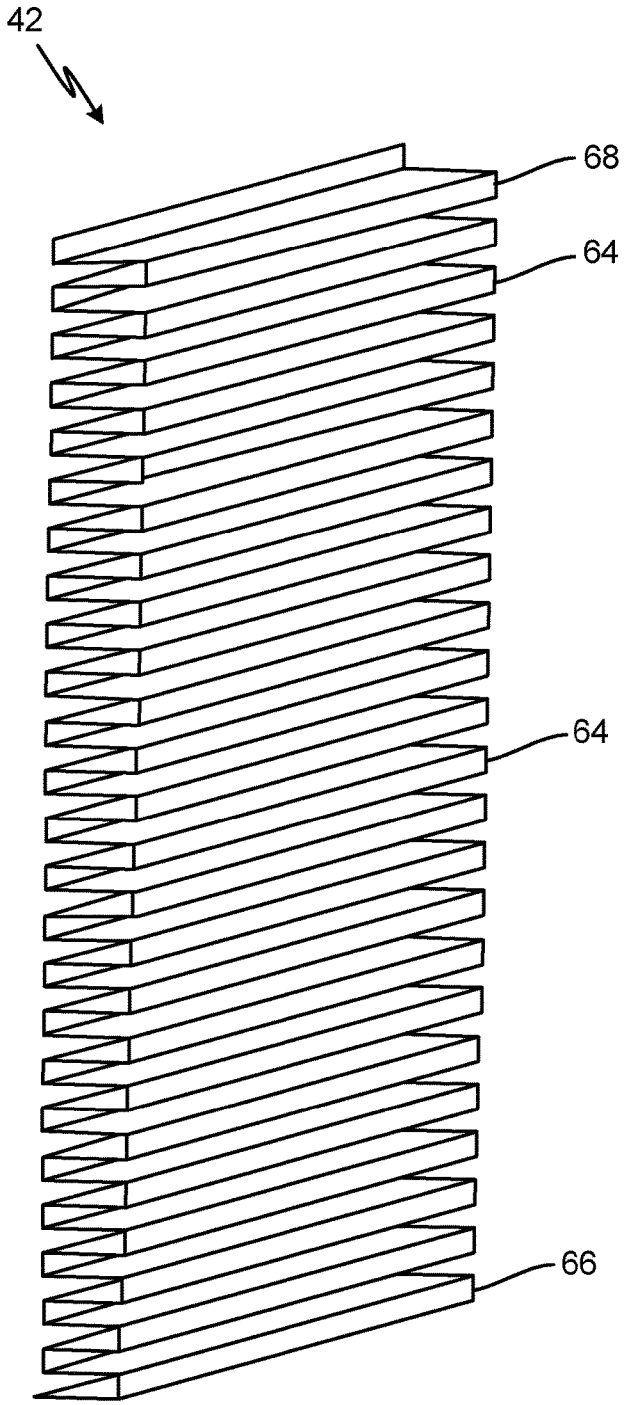
FIG. 6A is a perspective view of a cold layer of the heat exchanger.
Figure 6B:
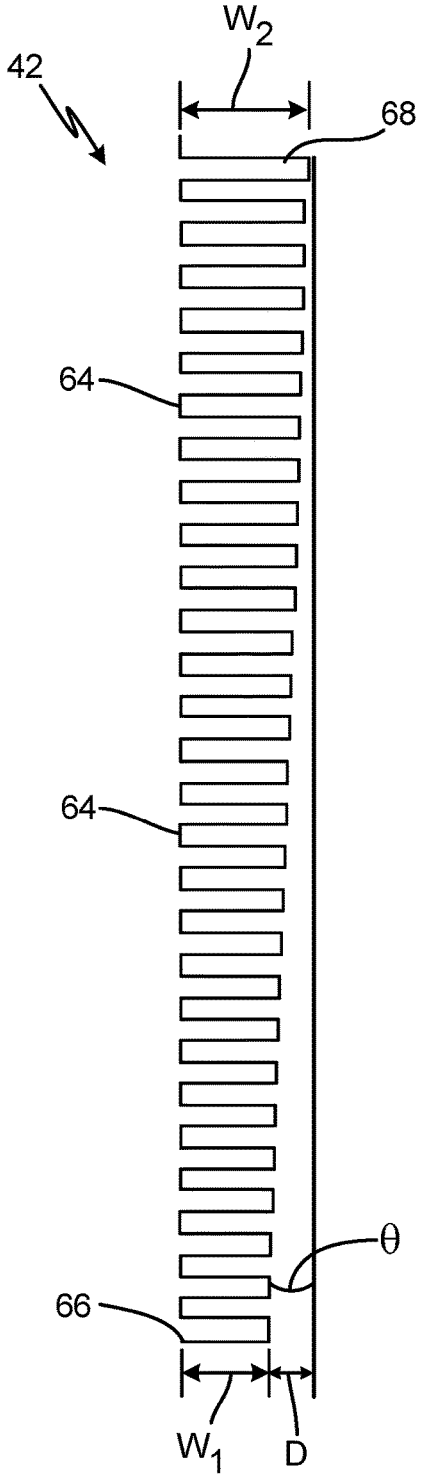
FIG. 6B is a side view of the cold layer.

FIG. 6A is a perspective view of cold layer 42 of heat exchanger 10 and shows fins 64, first end 66 of cold layer 42, and second end 68 of cold layer 42. FIG. 6B is a side view of cold layer 42 of heat exchanger 10 and shows fins 64, first end 66 of cold layer 42, second end 68 of cold layer 42, width $W_1$ of first end 66, width $W_2$ of second end 68, distance D, and angle θ. FIGS. 6A and 6B generally show the same or similar elements, and will be discussed in tandem.

Cold layer 42 is one of cold layers 42 shown as part of core 40 in FIG. 4. In one non-limiting embodiment, cold layer 42 is manufactured by stamping or pressing the corrugations into cold layer 42. Cold layer 42 is then rolled with rollers set at an angle relative to each other to produce the angle of taper (as shown in FIG. 3). Fins 64 are undulating heat exchanging fins that form fluidic channels. In this non-limiting embodiment, fins 64 of cold layer 42 include a shape with 90 degree bends or angles (e.g., a square waveform).

First end 66 is a bottom end of cold layer 42 (with the bottom direction as shown in FIGS. 6A and 6B). Second end 68 is a top end of cold layer 42 (with the top direction as shown in FIGS. 6A and 6B). Width $W_1$ is a width of first end 66 (measured from left to right in FIGS. 6A and 6B). Width $W_2$ is a width of second end 68 (measured from left to right in FIGS. 6A and 6B). Distance D is a difference between width $W_1$ and width $W_2$. Angle θ is a resulting angle caused by the difference in widths $W_1$ and $W_2$.

Fins 64 are interconnected to form a single zig-zag sheet of physical material. Fins 64 are configured in such a way so as to maximize a surface area of cold layer 42 so as to increase the heat exchanging capabilities of cold layer 42. First end 66 is a radially inward end of cold layer 42 relative to the configuration of core 40 as shown in FIG. 4. Second end 68 is a radially outward end of cold layer 42 relative to the configuration of core 40 as shown in FIG. 4. In this non-limiting embodiment, width $W_1$ is less than width $W_2$ of second end 68, width $W_2$ is greater than width $W_1$ of first end 66, distance D is greater than zero, and angle θ is greater than zero degrees.

Fins 64 function to transport a flow or flows of cold air (e.g., first and second airflows $AF_1$ and $AF_2$ shown in FIG. 3) through cold layer 42. Each of fins 64 provide individual fluidic channels through which the flow of cold air is transported. Fins 64 also provide the function of heat transfer between a surface area of fins 64 and the flow of air passing across fins 64. First end 66 with width $W_1$ and second end 68 with width $W_2$ function to create a tapered side profile of cold layer 42. The tapered side profile of cold layer 42 provides incremental points of core 40 which bend core 40 into a curved core. Distance D and angle θ of each of cold layers 42 creates an effective curvature of core 40 and thus of heat exchanger 10.

As discussed above with respect to heat exchanger 10 being curved, the curved shape of core 40 due to the tapered side profile of cold layers 42 allows heat exchanger 10 to more efficiently use curved space as compared to traditional rectangular heat exchangers. Using core 40 with cold layers 42 in assembly 26 allows for the use of space to be maximized due to the shape of heat exchanger 10 matching the contour of the curved shape of outer duct 34 and minimizing a space or gap between heat exchanger 10 and outer duct 34. In other words, the curved shape of core 40 due to the tapered side profile of cold layers 42 provides maximum utilization of available space by heat exchanger 10 within assembly 26.

Figure 7:
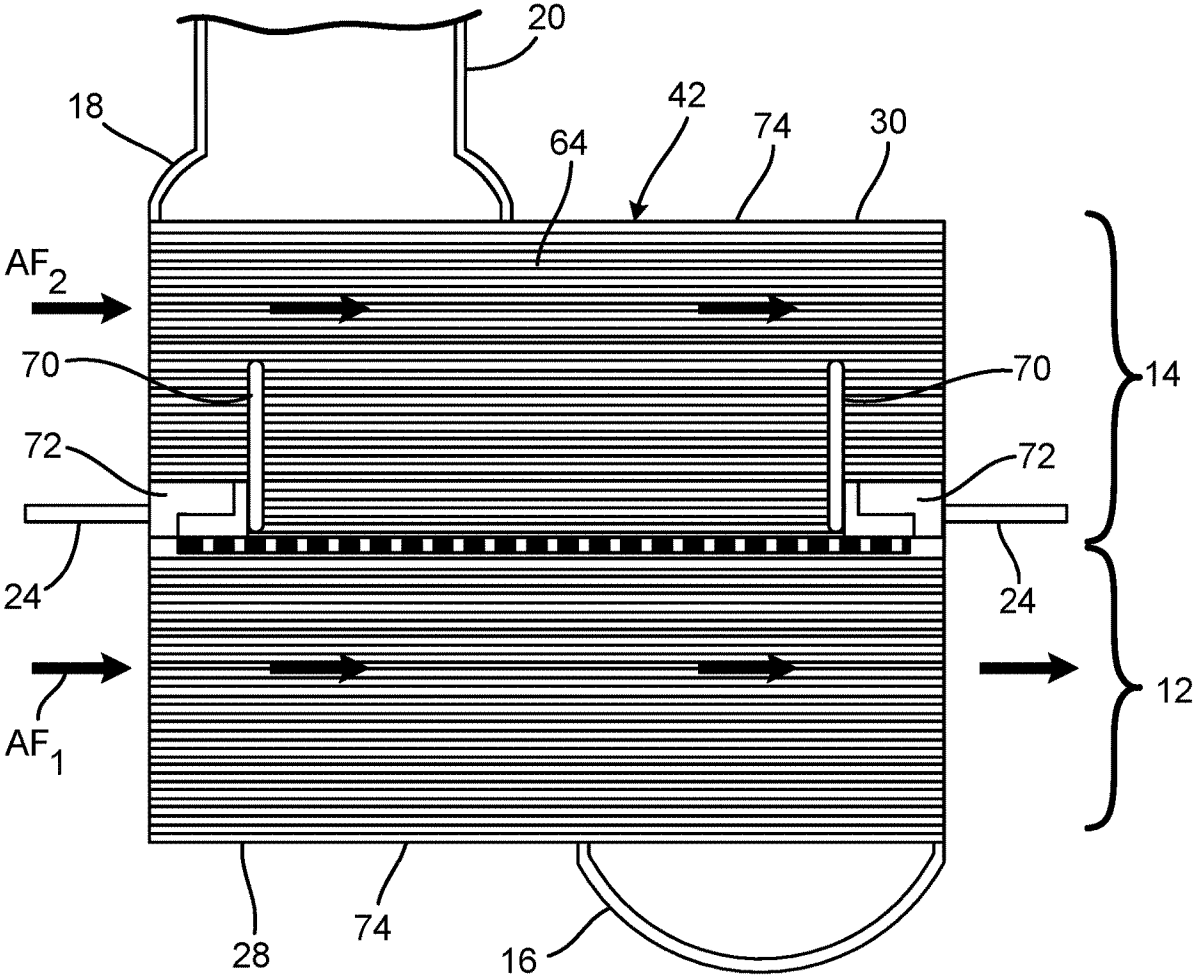
FIG. 7 is a cross-section view of a cold layer.

FIG. 7 is a cross-section view of heat exchanger 10 taken across one of cold layers 42 and shows inner portion 12 (with inner surface 28), outer portion 14 (with outer surface 30), inlet header 16, outlet header 18, mounting flange 24, outlet 20, first airflow $AF_1$, second airflow $AF_2$, cold layer 42 (with fins 64, slots 70, and sidewalls 74), and bars 72.

Slots 70 are openings or channels (e.g., redistribution slots) in fins 64 of cold layer 42. Bars 72 are pieces of solid material. Sidewalls 74 are closure bars that contain airflow within cold layer 42. As is shown in FIG. 7, mounting flange 24 is disposed at an approximate mid-point of heat exchanger 10. Slots 70 are disposed in and are in fluid communication with fins 46 in a portion of outer portion 14. Slots 70 are partially aligned in an axial direction (left to right in FIG. 7) with bars 72. Bars 72 are disposed in cold layer 42 and provide a connection point for mounting flanges 24 to connect to.

First airflow $AF_1$ passes through inner portion 12 and second airflow $AF_2$ passes through outer portion 14 such that first airflow $AF_1$ and second airflow $AF_2$ remain fluidly separated. First airflow $AF_1$ and second airflow $AF_2$ provide a cooling function with first airflow $AF_1$ and second airflow $AF_2$ in parallel. Slots 70 redistribute or allow a portion of first airflow $AF_1$ to drop behind bars 72 so as to transport a portion of first airflow $AF_1$ to fins 46 that are positioned in axial alignment with bars 72. Without slots 70, fins 46 placed in axial alignment would not receive any of first airflow $AF_1$ because bars 72 would block flow moving in a left to right direction.

Slots 70 enable a portion of first airflow $AF_1$ to pass between bars 72 thereby maximizing the surface area of cold layer 42 that first airflow $AF_1$ passes across. Bars 72 provide a connection point for mounting flanges 24 to connect to cold layer 42 of heat exchanger 10 in order to mount heat exchanger 10 to inner duct 22.

Figure 8:
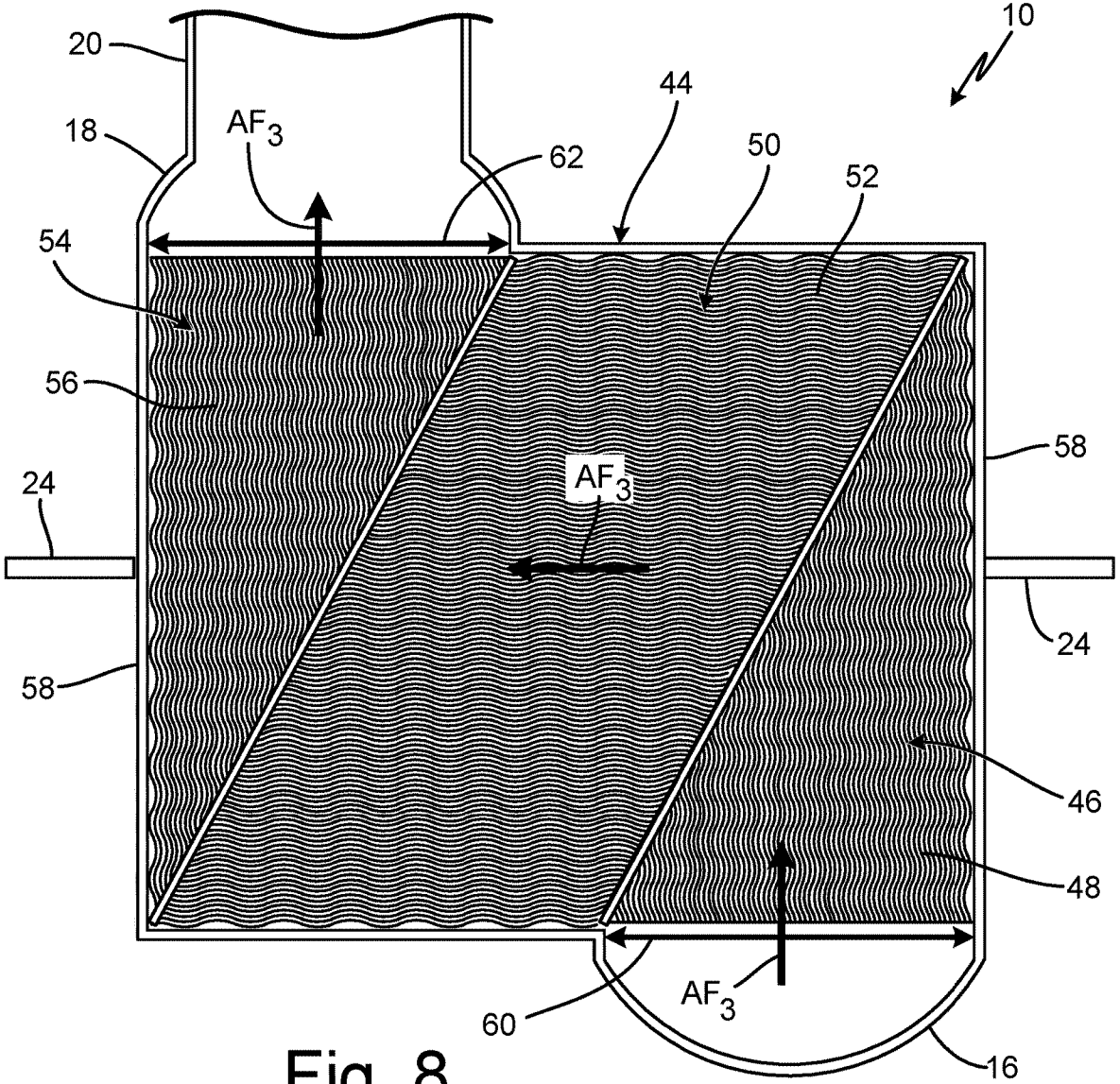
FIG. 8 is a cross-section view of a hot layer.

FIG. 8 is a cross-section view of heat exchanger 10 taken across one of hot layers 44 and shows inlet header 16, outlet header 18, mounting flange 24, outlet 20, hot layer 44 (with first region 46 of first fins 48, second region 50 of second fins 52, and third region 54 of third fins 56), third airflow $AF_3$, and sidewall 58 with first opening 60 and second opening 62. FIG. 8 illustrates the directions of third airflow $AF_3$ as third airflow $AF_3$ passes through each of first, second, and third regions 46, 50, and 54 of hot layer 44.

As third airflow $AF_3$ enters into first region 46 of first fins 48 from inlet header 16, third airflow $AF_3$ moves in a generally upward or vertical direction (upwards in FIG. 8).

As third airflow $AF_3$ transitions from first region 46 to second region 50, third airflow $AF_3$ turns approximately 90 degrees and into sideways direction of flow (from right to left in FIG. 8). As third airflow $AF_3$ transitions from second region 50 to third region 54, third airflow $AF_3$ again turns approximately 90 degrees and into a generally upward or vertical direction (upwards in FIG. 8). Third airflow $AF_3$ then passes from third region 54 into outlet header 18 and out through outlet 20.

The relative directions of third airflow $AF_3$ through hot layer 44 and of first and second airflows $AF_1$ and $AF_2$ (as shown in FIG. 7) create a counter-flow arrangement or configuration of heat exchanger 10. This counter-flow configuration of heat exchanger 10 increases the effectiveness of thermal transfer by exposing third airflow $AF_3$ of hot air to two separate cold airflows of first and second airflows $AF_1$ and $AF_2$.

In one non-limiting embodiment, a method of manufacturing heat exchanger 10 with cold layers 42 and hot layers 44 includes manipulating each of cold layers 42 such that each of cold layers 42 includes a tapered side profile. For example, manipulating each of cold layers 42 such that each of cold layers 42 includes a tapered side profile can include forming each of cold layers 42 to include a taper in a radial direction such that a radially outward end of each of cold layers 42 is larger than a radially inward end of each of cold layers 42 along a circumferential direction of core 40. The tapered side profile of each of cold layers 42 can be achieved by running each of cold layers 42 through rollers. An electrical discharge machine process is used to form 70 into each of cold layers 42.

Cold layers 42 and hot layers 44 are arranged into an alternating pattern such that each of hot layers 44 is adjacent to and in contact with at least one of cold layers 42. Cold layers 42 and hot layers 44 are oriented relative to each other such that separate first and second airflows $AF_1$ and $AF_2$ of cold layer 42 are used to cool third airflow $AF_3$ of hot layer 44. Cold layers 42 and hot layers 44 are brazed together to form the curved circumferentially stacked core 40. Mounting flanges 24 are welded onto core 40. Inlet and outlet headers 16 and 18 are also welded onto core 40.

Figure 9:
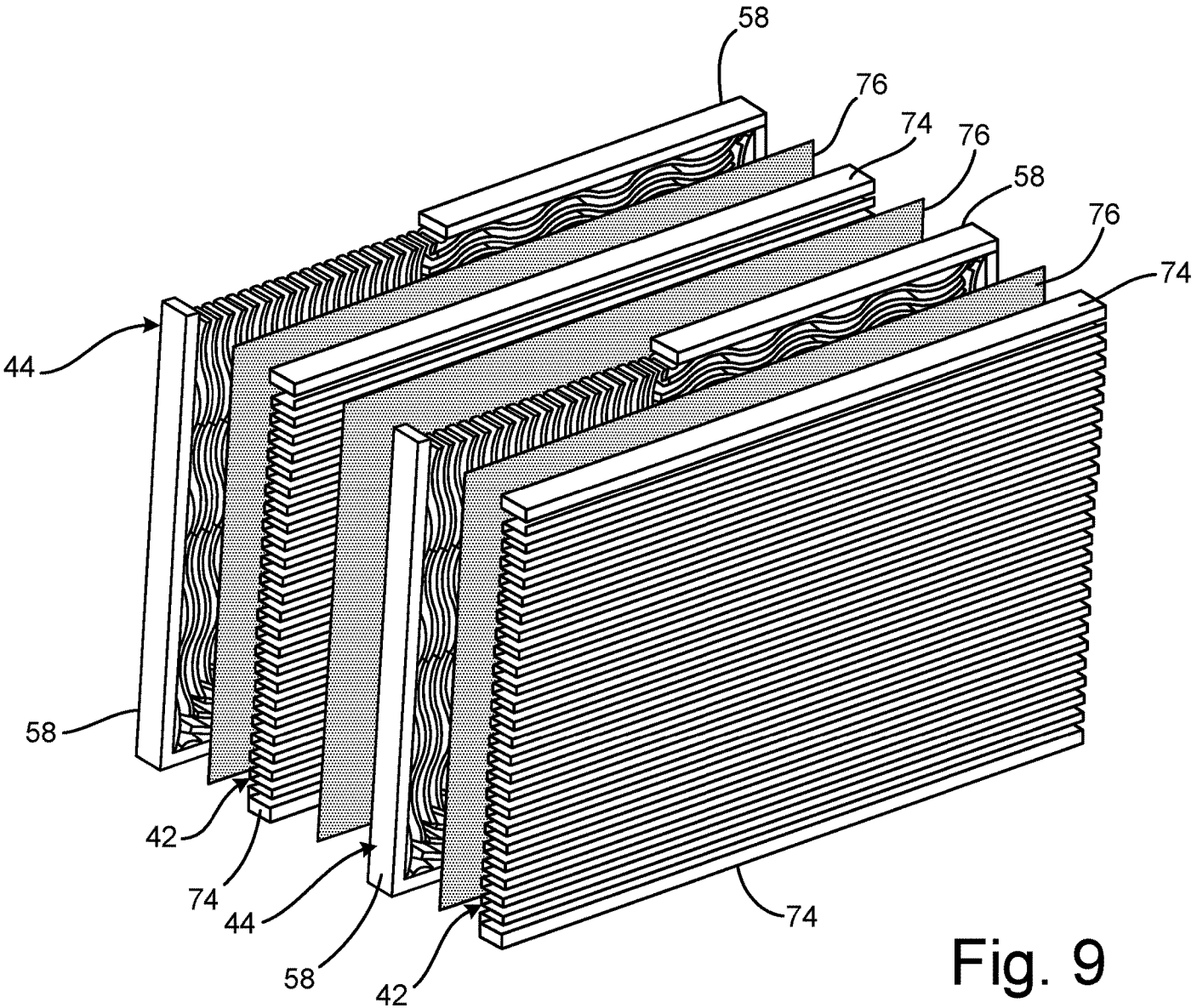
FIG. 9 is an exploded view of hot layers and cold layers.

FIG. 9 is an exploded view of cold layers 42 and hot layers 44 and shows cold layers 42 (with sidewalls 74), hot layers 44 (with sidewalls 58), and parting sheets 76. Sidewalls 74 are closure bars that contain airflow within cold layer 42. Parting sheets 76 are thin planar sheets of solid material. Cold and hot layers 42 and 44 are arranged in an alternating pattern with parting sheets disposed between each of the alternating layers of cold and hot layers 42 and 44. Parting sheets 76 provide a barrier between alternating layers of cold and hot layers 42 and 44. Parting sheets 76 prevent airflows passing through cold layers 42 from passing into hot layers 44 and vice-versa. As discussed with respect to FIG. 4 above, the tapered shape of cold fins 42 creates a slight radially inward curvature of core 40 at each of cold fins 42. The curved shape of core 40 by way of the tapered shape of cold fins 42 allows heat exchanger 10 to have a curved shape conforming to the curvature of inner and outer ducts 22 and 34.

Discussion of Possible Embodiments

The following are non-exclusive descriptions of possible embodiments of the present invention.

A heat exchanger assembly includes first and second annular ducts, first and second airflow pathways, and a heat exchanger with a partially annular shape. The first annular duct forms a fluidic barrier between the first and second airflow pathways. The first airflow pathway is configured to transport a first airflow and is disposed within and formed by the first annular duct. The second annular duct is disposed radially outward from the first annular duct. The second airflow pathway is configured to transport a second airflow and is disposed between and formed by the first and second annular ducts. The heat exchanger includes inner and outer portions. The inner portion is disposed radially inward of the first annular duct and is fluidly connected to the first airflow pathway. The outer portion is disposed between the first and second annular ducts and is fluidly connected to the second airflow pathway. The heat exchanger is configured to cool a third airflow with both of the first and second airflows from the first and second airflow pathways.

The heat exchanger assembly of the preceding paragraph can optionally include, additionally and/or alternatively, any one or more of the following features, configurations and/or additional components.

The heat exchanger can further comprise a first plurality of heat exchanger layers, and/or a second plurality of heat exchanger layers, wherein each layer of the first and second pluralities of heat exchanger layers can extend across the inner portion and/or outer portions, wherein the first and/or second pluralities of heat exchanger layers can be arranged in an alternating pattern such that each of the plurality of first heat exchanger layers can be adjacent to and/or in contact with at least one of the plurality of second heat exchanger layers, wherein each of the second heat exchanger layers can comprise a taper in a radial direction such that a radially outward end of each of the second heat exchanger layers can be larger than a radially inward end of each of the second heat exchanger layers along a circumferential direction.

The first annular duct can include a cutout, wherein a portion of the heat exchanger can be mounted within the cutout.

A flange can extend axially from the heat exchanger, wherein the flange can be mounted to the first annular duct.

The first annular duct can include a first radius, wherein the second annular duct can include a second radius, wherein the heat exchanger can include an outer surface with a third radius, wherein the third radius can be greater than the first radius and/or less than the second radius.

A difference between third radius and the second radius can remain constant along a circumference of the second annular duct.

The heat exchanger can comprise a circumferentially stacked counter-flow curved heat exchanger.

The second plurality of heat exchanger layers can comprise a redistribution slot disposed in each of the second plurality of heat exchanger layers.

A method of manufacturing a heat exchanger with cold layers and hot layers includes manipulating each of the cold layers such that each of the cold layers includes a tapered side profile. The cold and hot layers are arranged into an alternating pattern such that each of the hot layers can be adjacent to and in contact with at least one of the cold layers. The hot layers and cold layers are brazed together to form a core.

The method of the preceding paragraph can optionally include, additionally and/or alternatively, any one or more of the following steps, features, configurations and/or additional components.

Each of the cold layers can be formed to include a taper in a radial direction such that a radially outward end of each of the cold layers can be larger than a radially inward end of each of the cold layers along a circumferential direction of the core.

The hot and cold layers can be oriented relative to each other such that two separate cold airflows of the cold layer can be used to cool a single hot airflow of the hot layer.

The hot and cold layers can be brazed together to form a curved circumferentially stacked core.

A tapered side profile of each of the cold layers can be formed by running each of the cold layers through rollers.

Mounting flanges can be welded onto the core.

Inlet and/or outlet headers can be welded onto the core.

An electrical discharge machine process can be used to form a redistribution slot into the cold layer.

A heat exchanger for an engine with a duct and first and second airflow pathways includes a partially annular curved core, an inner portion fluidly connected to the first airflow pathway, and an outer portion disposed radially outward from the inner portion. The partially annular curved core includes a plurality of hot layers and a plurality of cold layers. Each of the plurality of hot layers is configured to transport a third airflow. The hot and cold layers are arranged in a stack such that each of the plurality of hot layers is adjacent to and in contact with at least one of the cold layers in the stack. Each of the cold layers comprises a taper in a radial direction such that a radially outward end of each of the cold layers is larger than a radially inward end of each of the cold layers along a circumferential direction of the partially annular curved core. The inner portion comprises radially inward halves of the hot and cold layers. The outer portion is fluidly connected to the second airflow pathway and comprises radially outward halves of the hot and cold layers. The heat exchanger is configured to cool the third airflow with airflows from the first and second airflow pathways.

The heat exchanger of the preceding paragraph can optionally include, additionally and/or alternatively, any one or more of the following features, configurations and/or additional components.

A curvature of the heat exchanger can conform to a curvature of the duct of the engine.

The heat exchanger can comprise a circumferentially stacked counter-flow curved heat exchanger.

A curved flange can extend from the heat exchanger, wherein the curved flange can be configured to mount the heat exchanger to the engine.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment(s) disclosed, but that the invention will include all embodiments falling within the scope of the appended claims.

The invention claimed is:

1. A heat exchanger assembly comprising:

a first annular duct, wherein the first annular duct includes a cutout;

a first airflow pathway disposed within and formed by the first annular duct, wherein the first airflow pathway is configured to transport a first airflow;

a second annular duct disposed radially outward from the first annular duct;

a second airflow pathway disposed between and formed by the first and second annular ducts, wherein the second airflow pathway is configured to transport a second airflow, wherein the first annular duct forms a fluidic barrier between the first and second airflow pathways;

a heat exchanger with a partially annular shape, wherein the heat exchanger is disposed within the cutout, wherein the heat exchanger comprises:

an inner portion disposed radially inward of the first annular duct, wherein the inner portion is fluidly connected to the first airflow pathway;

an outer portion disposed between the first and second annular ducts, wherein the outer portion is fluidly connected to the second airflow pathway, wherein the heat exchanger is configured to cool a third airflow with both of the first and second airflows from the first and second airflow pathways;

a first plurality of heat exchanger layers; and a second plurality of heat exchanger layers, wherein each layer of the first and second pluralities of heat exchanger layers extends across the inner portion and outer portions, wherein the first and second pluralities of heat exchanger layers are arranged in an alternating pattern such that each of the plurality of first heat exchanger layers is adjacent to and in contact with at least one of the plurality of second heat exchanger layers, wherein each of the second heat exchanger layers comprises a taper in a radial direction such that a radially outward end of each of the second heat exchanger layers is larger than a radially inward end of each of the second heat exchanger layers along a circumferential direction, wherein the second plurality of heat exchanger layers comprises a redistribution slot disposed in each of the second plurality of heat exchanger layers, wherein the second plurality of heat exchanger layers comprises a bar disposed in each of the second plurality of heat exchanger layers; and a curved flange connected to and extending axially from the heat exchanger, wherein the heat exchanger is mounted to the first annular duct via the curved flange, wherein the curved flange is connected to the bar.

2. The heat exchanger assembly of claim 1, wherein the first annular duct includes a first radius, wherein the second annular duct includes a second radius, wherein the heat exchanger includes an outer surface with a third radius, wherein the third radius is greater than the first radius and less than the second radius.

3. The heat exchanger assembly of claim 2, wherein a difference between third radius and the second radius remains constant along a circumference of the second annular duct.

4. The heat exchanger assembly of claim 1, wherein the heat exchanger comprises a circumferentially stacked counter-flow curved heat exchanger.

5. The heat exchanger assembly of claim 1, wherein a shape of a boundary of the cutout is sized to match a shape of the heat exchanger at a portion of the heat exchanger adjacent the curved flange.

6. The heat exchanger assembly of claim 1, wherein the second plurality of heat exchanger layers comprises a bar disposed in each of the second plurality of heat exchanger layers, wherein the bar is aligned in an axial direction with the redistribution slot.

7. A heat exchanger assembly comprising:

a first annular duct, wherein the first annular duct includes a cutout;

a first airflow pathway disposed within and formed by the first annular duct, wherein the first airflow pathway is configured to transport a first airflow;

a second annular duct disposed radially outward from the first annular duct;

a second airflow pathway disposed between and formed by the first and second annular ducts, wherein the second airflow pathway is configured to transport a second airflow, wherein the first annular duct forms a fluidic barrier between the first and second airflow pathways;

a heat exchanger with a partially annular shape, wherein the heat exchanger is disposed within the cutout, wherein the heat exchanger comprises:

an inner portion disposed radially inward of the first annular duct, wherein the inner portion is fluidly connected to the first airflow pathway;

an outer portion disposed between the first and second annular ducts, wherein the outer portion is fluidly connected to the second airflow pathway, wherein the heat exchanger is configured to cool a third airflow with both of the first and second airflows from the first and second airflow pathways;

a first plurality of heat exchanger layers; and a second plurality of heat exchanger layers, wherein each layer of the first and second pluralities of heat exchanger layers extends across the inner portion and outer portions, wherein the first and second pluralities of heat exchanger layers are arranged in an alternating pattern such that each of the plurality of first heat exchanger layers is adjacent to and in contact with at least one of the plurality of second heat exchanger layers, wherein each of the second heat exchanger layers comprises a taper in a radial direction such that a radially outward end of each of the second heat exchanger layers is larger than a radially inward end of each of the second heat exchanger layers along a circumferential direction, wherein the second plurality of heat exchanger layers comprises a redistribution slot disposed in each of the second plurality of heat exchanger layers, wherein the second plurality of heat exchanger layers comprises a bar disposed in each of the second plurality of heat exchanger layers, wherein the bar is aligned in an axial direction with the redistribution slot; and a curved flange connected to and extending axially from the heat exchanger, wherein the heat exchanger is mounted to the first annular duct via the curved flange.

8. The heat exchanger assembly of claim 7, wherein the first annular duct includes a first radius, wherein the second annular duct includes a second radius, wherein the heat exchanger includes an outer surface with a third radius, wherein the third radius is greater than the first radius and less than the second radius.

9. The heat exchanger assembly of claim 8, wherein a difference between third radius and the second radius remains constant along a circumference of the second annular duct.

10. The heat exchanger assembly of claim 7, wherein the heat exchanger comprises a circumferentially stacked counter-flow curved heat exchanger.

* * * * *